US005222940A

United States Patent [19]

Wilk

[11] Patent Number: 5,222,940

[45] Date of Patent: Jun. 29, 1993

[54] DEVICE FOR FACILITATING ADMINISTRATION OF MEDICINE

[76] Inventor: Peter J. Wilk, 185 W. End Ave., New York, N.Y. 10023

[21] Appl. No.: 816,462

[22] Filed: Jan. 3, 1992

[51] Int. Cl.[5] ..... A47G 19/22

[52] U.S. Cl. ..... 604/77; 215/1 A; 215/229; 220/710; 239/33

[58] Field of Search ..... 604/77, 78; 215/1 A, 215/229; 239/33; 220/703, 705, 709, 710

[56] References Cited

U.S. PATENT DOCUMENTS

| | | | |
|---|---|---|---|
| 293,190 | 2/1884 | Moore | 220/710 |
| 560,916 | 5/1896 | McDonough et al. | 220/703 |
| 860,501 | 7/1907 | Tatum | 220/703 |
| 1114,254 | 10/1914 | Greene et al. | 239/33 |
| 1,254,115 | 1/1918 | Brand . | |
| 1,770,118 | 7/1930 | Williams . | |
| 2,128,448 | 8/1938 | Wright . | |
| 2,355,010 | 8/1944 | Pera | 239/33 |
| 3,252,803 | 5/1966 | Belasco . | |
| 3,391,830 | 7/1968 | Kitchens | 220/705 |
| 3,526,316 | 9/1970 | Kalogris . | |
| 3,717,476 | 2/1973 | Harvey . | |
| 3,730,737 | 5/1973 | Harvey et al. . | |
| 4,016,998 | 4/1977 | Finch | 215/1 A |
| 4,061,783 | 12/1977 | Hoffman et al. . | |
| 4,607,755 | 8/1986 | Andreozzi | 215/229 |
| 4,816,268 | 3/1989 | Tsau . | |
| 4,848,622 | 7/1989 | Kroetsch | 604/78 |
| 4,849,231 | 7/1989 | Spee . | |
| 4,921,713 | 5/1990 | Fowler . | |
| 4,928,876 | 5/1990 | Marshall | 220/705 |
| 4,953,725 | 9/1990 | Gil Buj | 215/1 A |

FOREIGN PATENT DOCUMENTS

| | | | |
|---|---|---|---|
| 81114 | 8/1920 | Austria | 220/705 |
| 2312220 | 1/1977 | France | 215/1 A |
| 79262 | 3/1919 | Switzerland | 604/78 |
| 2057306 | 4/1981 | United Kingdom . | |

*Primary Examiner*—Ralph Lewis

*Attorney, Agent, or Firm*—R. Neil Sudol; Henry D. Coleman

[57] ABSTRACT

A device for facilitating administration of medicine to a patient comprises a straw having a lower end and an upper end, a cup-shaped member defining a receptacle space, and graduation markings or other indicators on the cup-shaped member for providing a volumetric indication of an amount of liquid deposited into the receptacle space. The cup-shaped member is connected to the straw at the lower end so that a lower tip of the straw communicates with a lower region of the receptacle space.

9 Claims, 1 Drawing Sheet

DEVICE FOR FACILITATING ADMINISTRATION OF MEDICINE

BACKGROUND OF THE INVENTION

This invention relates to a device for facilitating administration of medicine to a patient, particularly liquid medicine.

Many patients, whether children or adults with a swallowing or other disability, are incapable of effectively taking certain medicaments. Medicines in liquid form are frequently spilled during administration to the patient. In such circumstances, it becomes difficult to apprehend just how much medicine the patient has taken and how much has been lost.

Other patients have difficulty swallowing medicaments in pill form.

OBJECTS OF THE INVENTION

An object of the present invention is to provide a device for facilitating the administration of medicines, particularly medicines in liquid form.

Another object of the present invention is to provide such a device which is inexpensive to manufacture and which can therefore be provided as a disposable or throw-away item.

Another, more particular, object of the present invention is to provide such a device which enables a relatively accurate determination of the amount of medicine ingested by a patient.

A further particular object of the present invention is to provide such a device which is attractive to children and encourages their ingestion of liquid medicines.

SUMMARY OF THE INVENTION

A device for facilitating administration of medicine to a patient comprises, in accordance with the present invention, a straw having a lower end and an upper end, a cup-shaped member defining a receptacle space, and graduation markings or other indicators on the cup-shaped member for providing a volumetric indication of an amount of liquid deposited into the receptacle space. The cup-shaped member is connected to the straw at the lower end so that a lower tip of the straw communicates with a lower region of the receptacle space.

In a more particular embodiment of the present invention, the straw may be attached to the cup-shaped member so as to be inserted into the receptacle space. The straw, may, for example, be connected the cup-shaped member along an inner surface thereof.

Pursuant to another feature of the present invention, the cup-shaped member is provided along an upper end with a lip for facilitating the pouring of a medicinal liquid into the receptacle space.

The receptacle space preferably has a transverse cross-sectional area (through a horizontal plane) which is approximately equal to the transverse cross-sectional area of the straw. Thus, in the embodiment where the straw is inserted into the receptacle space, the cup-shaped member forms a loose collar shape about the lower end portion of the straw. Moreover, the straw and the cup-shaped member together present the aspect of a saxophone.

A device for facilitating administration of medicine to a patient comprises, in accordance with a more particular conceptualization of the present invention, a straw having a lower end and an upper end and a cup-shaped member defining a receptacle space. The cup-shaped member is connected to the straw at the lower end thereof so that a lower tip of the straw is located in a bottom region of the receptacle space. Graduation markings or other indicators are on the cup-shaped member for providing a volumetric indication of an amount of liquid deposited into the receptacle space.

A device in accordance with the present invention facilitates the administration of medicines, particularly medicines in liquid form. The device is inexpensive to manufacture and can therefore be provided as a disposable or throw-away item.

A medicine administration device in accordance with the present invention enables a quick and relatively accurate determination of the amount of medicine ingested by a patient. Moreover, the device is attractive to children and encourages their ingestion of liquid medicines.

DETAILED DESCRIPTION

Figure 1:
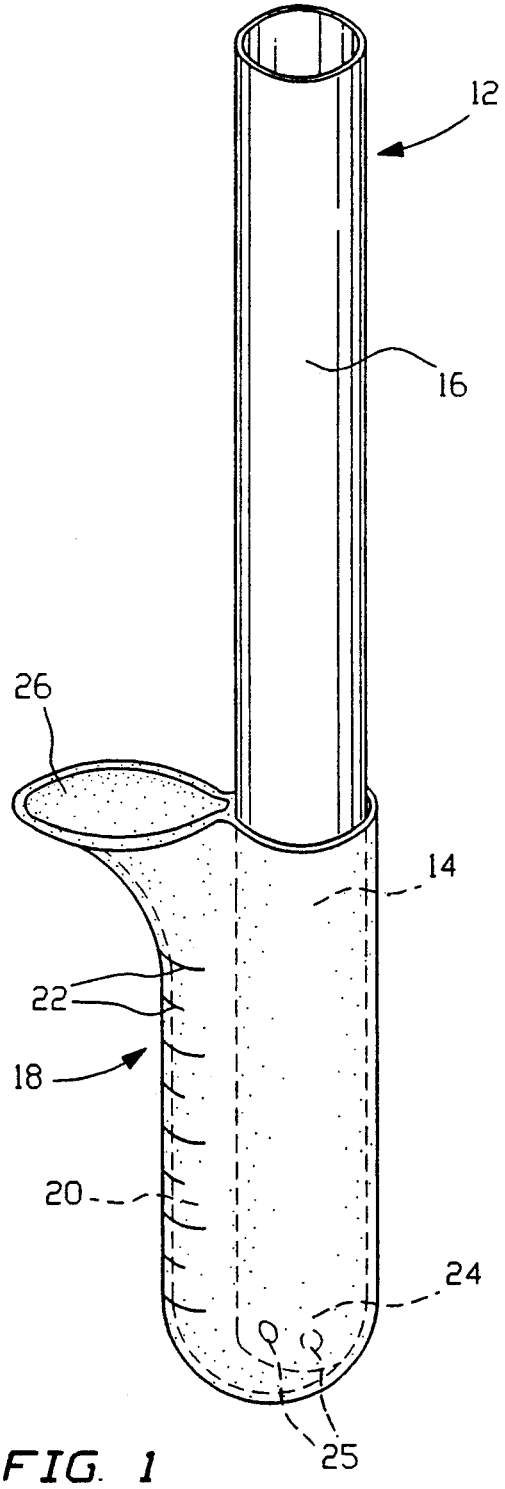
FIG. 1 is a schematic side-elevational view of a medicine administration device in accordance with the present invention.

As illustrated in FIG. 1, a device for facilitating administration of medicine to a patient comprises a straw 12 having a lower end 14 and an upper end 16. A substantially cup- or funnel-shaped, preferably transparent member 18 defines a receptacle space 20 and is formed with a plurality of spaced graduation markings or other indicators 22 for providing a volumetric indication of an amount of liquid (not shown) deposited into the receptacle space for administration to a patient.

Cup-shaped member 18 is connected to straw 12 at lower end 14 so that the a lower tip 24 of the straw provided with one or more openings 25 communicates with a lower region of receptacle space 20. More specifically stated, straw 12 is attached to cup-shaped member 18 along an inner surface thereof so as to be inserted into receptacle space 20.

Cup-shaped member 18 is provided along a mouth at an upper end with a lip 26 for facilitating the pouring of a medicinal liquid into the receptacle space 20.

Receptacle space 20 has a transverse cross-sectional area (through a horizontal plane) which is approximately equal to the transverse cross-sectional area of straw 12. Thus, cup-shaped member 18 forms a loose collar shape about the lower end portion 14 of straw 12. Moreover, straw 12 and cup-shaped member 18 together present the aspect of a saxophone.

Figure 2:
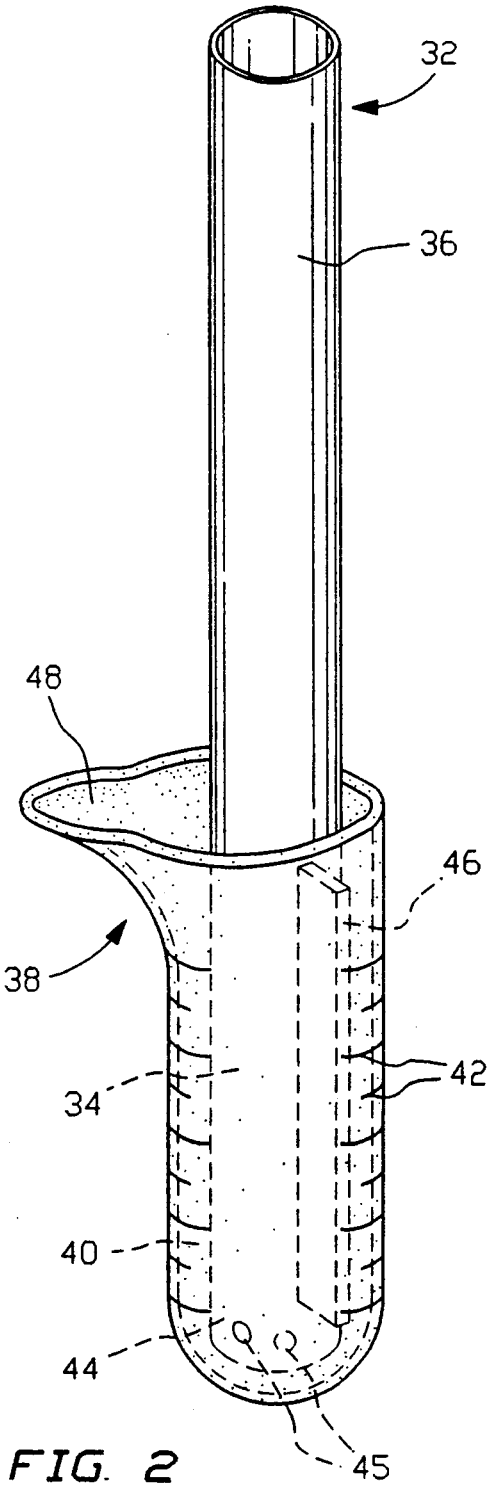
FIG. 2 is a schematic side-elevational view of another medicine administration device in accordance with the present invention.

As illustrated in FIG. 2, another device for facilitating administration of medicine to a patient comprises a straw 32 having a lower end 34 and an upper end 36. A substantially cup-shaped, preferably transparent member 38 defines a receptacle space 40 and is formed with a plurality of spaced graduation markings or other indicators 42 for providing a volumetric indication of an amount of liquid (not shown) deposited into the receptacle space for administration to a patient.

Straw 32 is disposed substantially centrally inside receptacle space 40 so that a lower tip 44 of the straw provided with openings 45 communicates with a lower region of receptacle space 40. Straw 32 is connected to cup-shaped member 38, e.g., via one or more radially oriented webs or buttresses 46.

Cup-shaped member 38 is provided along an upper end with a lip 48 for facilitating the pouring of a medicinal liquid into the receptacle space 40.

Receptacle space 40 has a transverse cross-sectional area (through a horizontal plane) which is approximately equal to the transverse cross-sectional area of straw 32. Thus, cup-shaped member 38 forms a loose collar shape about the lower end portion 34 of straw 32.

Although the invention has been described in terms of particular embodiments and applications, one of ordinary skill in the art, in light of this teaching, can generate additional embodiments and modifications without departing from the spirit of or exceeding the scope of the claimed invention. For example, straw 12 may be connected to cup-shaped member 18 along an outer-surface thereof. Graduation markings 22 may be provided along an inner surface of cup-shaped member 18 or may take a continuous form (e.g., color coded). Accordingly, it is to be understood that the drawings and descriptions herein are preferred by way of example to facilitate comprehension of the invention and should not be construed to limit the scope thereof.

What is claimed is:

1. A device for facilitating administration of medicine to a patient, comprising:

a straw having a lower end and an upper end, said straw having a first transverse cross-sectional area at said lower end;

a substantially funnel-shaped member defining a receptacle space, said funnel-shaped member having a mouth opening of a second transverse cross-sectional area at one end and further having at an opposite end a bottom region with a third transverse cross-sectional area smaller than said second transverse cross-sectional area, said opposite end of said funnel-shaped member being connected to said straw at said lower end so that a lower tip of said straw communicates with said bottom region, said third cross-sectional area being outside of said straw and having a size between zero and approximately the size of said first transverse cross-sectional area, said straw being longer than said funnel-shaped member and extending in a direction beyond said one end of said funnel-shaped member; and graduation means on said funnel-shaped member for providing a volumetric indication of an amount of liquid deposited into said receptacle space.

2. The device defined in claim 1 wherein said funnel-shaped member is provided along said one end with a lip for facilitating the pouring of a medicinal liquid through said mouth into said receptacle space.

3. The device defined in claim 1 wherein said straw and said funnel-shaped member together present the aspect of a saxophone.

4. The device defined in claim 1 wherein said straw provided at said lower end with a plurality of openings communicating with said receptacle space.

5. A device for facilitating administration of medicine to a patient, comprising:

a straw having a lower end and an upper end; and a cup-shaped receptacle member attached along a side to said straw and communicating with said lower end thereof for enabling a user to measure out and hold, at said lower end of said straw, an effective amount of liquid medication, said straw having a transverse cross-sectional area at said lower end, said receptacle member having a cross-section tapering down from a relatively wide mouth at one end to an area at an opposite end substantially equal to said transverse cross-sectional area, said straw being longer than said receptacle member and extending in a direction beyond said one end of said receptacle member.

6. The device defined in claim 5 wherein said cup-shaped receptacle member is provided along said mouth opening with a lip for facilitating the pouring of a medicinal liquid through said mouth opening into said receptacle.

7. The device defined in claim 5 wherein said straw and said cup-shaped receptacle member together present the aspect of a saxophone.

8. The device defined in claim 5 wherein said straw is provided at said lower end with a plurality of openings communicating with said receptacle space.

9. The device defined in claim 5 wherein said straw is disposed partially inside said cup-shaped member.

* * * * *